US010415826B2

(12) United States Patent
Pedersen

(10) Patent No.: US 10,415,826 B2
(45) Date of Patent: Sep. 17, 2019

(54) FILAMENT RETAINING DEVICE

(71) Applicant: Rodstation Ltd, Cowbridge (GB)

(72) Inventor: Adam Pedersen, Cowbridge (GB)

(73) Assignee: RODSTATION LTD., Cowbridge (GB)

( * ) Notice: Subject to any disclaimer, the term of this patent is extended or adjusted under 35 U.S.C. 154(b) by 438 days.

(21) Appl. No.: 15/160,052

(22) Filed: May 20, 2016

(65) Prior Publication Data

US 2016/0341422 A1 Nov. 24, 2016

(30) Foreign Application Priority Data

May 21, 2015 (GB) ..... 1508738.0
Jan. 22, 2016 (GB) ..... 1601192.6

(51) Int. Cl.
*F23J 3/02* (2006.01)
*B08B 9/04* (2006.01)
*A46B 3/08* (2006.01)

(52) U.S. Cl.
CPC ..... *F23J 3/026* (2013.01); *A46B 3/08* (2013.01); *B08B 9/04* (2013.01); *A46B 2200/3013* (2013.01)

(58) Field of Classification Search
CPC ..... A46B 2200/3013; A46B 3/08; B08B 9/04; F23J 3/026
See application file for complete search history.

(56) References Cited

U.S. PATENT DOCUMENTS 2,072,110 A * 3/1937 Jennings ..... A46B 13/001 15/104.2
2,215,514 A * 9/1940 Macgregor ..... E21B 37/08 15/104.061
2,626,413 A * 1/1953 Girton ..... B08B 1/00 15/104.095
3,314,095 A * 4/1967 Prange ..... A46B 13/001 15/104.2
5,115,534 A * 5/1992 Fournier ..... A46B 3/08 15/179
2016/0341422 A1* 11/2016 Pedersen ..... A46B 3/08

FOREIGN PATENT DOCUMENTS

| | | |
|---|---|---|
| DE | 528289 | 6/1931 |
| EP | 2657601 | 10/2013 |
| FR | 1388887 | 2/1965 |

OTHER PUBLICATIONS

Extended European Search Report dated Sep. 28, 2016, EP Patent Application No. 16170220.4.
Patent Search Report Issued under GB1508738 dated Oct. 20, 2015.

* cited by examiner

*Primary Examiner* — Marc Carlson
(74) *Attorney, Agent, or Firm* — Boyle Fredrickson S.C.

(57) ABSTRACT

A filament retaining device is disclosed for a chimney and duct cleaning tool. The device comprises a socket having a bore defined by a side wall of the socket and a plurality of pairs of apertures disposed in the side wall of the socket, the pairs of apertures being separated longitudinally of the socket. The device further comprises a plug arranged to move in sliding relation within the bore of the socket. The plug comprises a plurality of channels disposed therein, separated longitudinally of the plug, and separately alignable with a pair of apertures in the side wall. The device further comprises an adjustment member for adjusting a position of the plug within the bore.

18 Claims, 4 Drawing Sheets

FILAMENT RETAINING DEVICE

CROSS-REFERENCE TO RELATED APPLICATION

This application claims the benefit of priority under 35 U.S.C. § 119 to British patent application GB 1508738.0, filed May 21, 2015, the disclosure of which is incorporated herein by reference in its entirety. This application also claims the benefit of priority under 35 U.S.C. § 119 to British patent application GB 1601192.6, filed Jan. 22, 2016, the disclosure of which is incorporated herein by reference in its entirety.

BACKGROUND OF THE INVENTION

The present invention relates to a filament retaining device and particularly, but not exclusively, to a filament retaining device for a chimney and duct cleaning tool.

When cleaning chimneys and ducts it is common to insert a brush head or similar within the chimney or duct. The brush head comprises a boss having a plurality of bristles or filaments rigidly coupled thereto, which are arranged to contact an interior of the chimney or duct to dislodge any debris disposed thereon. The brush head is connected with a handle via the boss, so that the brush head can be rotated as the head is moved along the chimney or duct.

The level of cleaning required depends on the type of chimney or duct and the waste that is passed therealong. Accordingly, several brushes are often required, each having a different set of filaments to suit the particular chimney or duct. This is often undesirable, since several brushes must be transported to a particular site.

It is also found that over a prolonged period of use, the filaments can wear to an extent that they do not adequately contact the interior of the chimney or duct and as such, do not effectively dislodge the debris disposed thereon. However, traditional brushes comprise filaments which are rigidly coupled to the boss, and as such, it is necessary to replace the complete brush head, once the filaments have become sufficiently worn.

We have now devised a filament retaining device.

SUMMARY OF THE INVENTION

In accordance with the present invention, as seen from a first aspect, there is provided a filament retaining device for a chimney and duct cleaning tool, the device comprising a socket having a bore defined by a side wall of the socket and a plurality of pairs of apertures disposed in the side wall of the socket, the pairs of apertures being separated longitudinally of the socket, the device further comprising a plug arranged to move in sliding relation within the bore of the socket, the plug comprising a plurality of channels disposed therein, the channels being separated longitudinally of the plug and separately alignable with a pair of apertures in the side wall, the device further comprising an adjustment member for adjusting a position of the plug within the bore.

In an embodiment, the plurality of pairs of apertures are longitudinally separated along a filament receiving portion of the socket, and the adjustment member is arranged to adjust the position of the plug relative to the filament receiving portion.

Preferably, the device further comprises biasing means, such as a spring, for biasing the plug longitudinally of the bore. In an embodiment, the adjustment member is arranged adjust a minimum separation of the plug from the proximal end of the socket and the biasing means is arranged to bias the plug toward the proximal end of the socket. The biasing means is preferably disposed within the bore at a distal region of the socket, and comprises a compression spring.

In an embodiment, the adjustment member comprises a detent which is arranged to screw into and out from the bore via a proximal end of the socket. The bore comprises a first bore section disposed at a proximal region of the socket and a second bore section disposed at a distal region of the socket. Preferably, the second bore section comprises a reduced cross-sectional area than the first bore section. A junction between the first and second bore section is preferably defined by an internally threaded section of the bore, which is arranged to receive the adjustment member.

In an embodiment, the plug comprises an elongate body and the channels of the plug preferably comprise linear channels which extend along a diameter of the plug. Preferably, the channels are angularly separated around the plug. Alternatively, or in addition thereto, the channels of the plug may comprise annular channels. In an embodiment, the plug comprises a plurality of discs arranged in a stacked configuration, and separated by a pillar which extends along an axis of the plug, such that the annular channels are disposed between adjacent discs.

In an embodiment, the apertures of each pair are arranged at diametrically opposed positions of the socket. Preferably, the pairs of apertures are angularly separated with respect to each other, around the socket.

In an embodiment, each channel formed within the plug is arranged to align with a pair of apertures.

In an embodiment, the bore is closed at a distal end of the socket and the distal end of the socket may be domed.

In an embodiment, the socket further comprises means for detachably coupling the device to a handle.

In accordance with the present invention as seen from a second aspect, there is provided a chimney and duct cleaning tool, the tool comprising the filament retaining device of the first aspect, a plurality of filaments for coupling with the retaining device and a handle for manipulating the tool.

In an embodiment, the handle comprises at least one rod which is arranged to detachably couple with the device.

In an embodiment, the filaments of the tool are arranged to separately extend through a pair of apertures within the socket and the channel aligned therebetween. Preferably, the filaments comprise nylon strands, chains, wire or similar material.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments.

Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE DRAWINGS

The invention may be performed in various ways, and, by way of example only, embodiments thereof will now be described, reference being made to the accompanying drawings in which.

DETAILED DESCRIPTION

Figure 1:
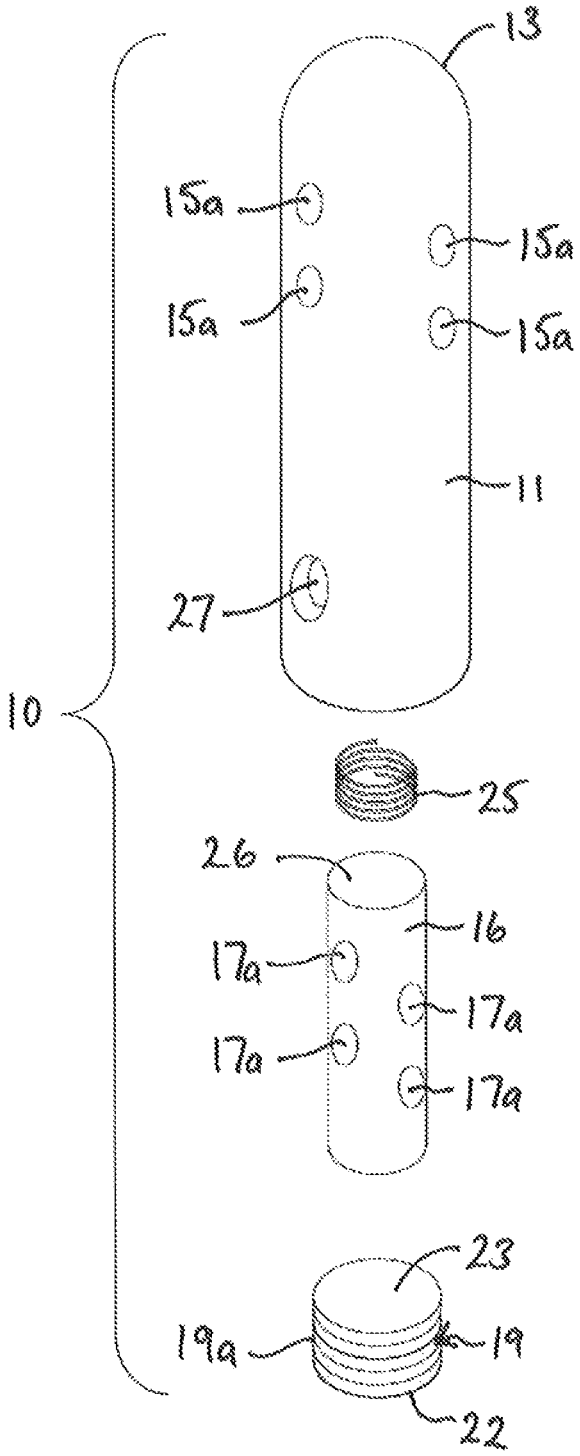
FIG. 1 is an exploded view of the filament retaining device according to a first embodiment of the present invention.
Figure 2:
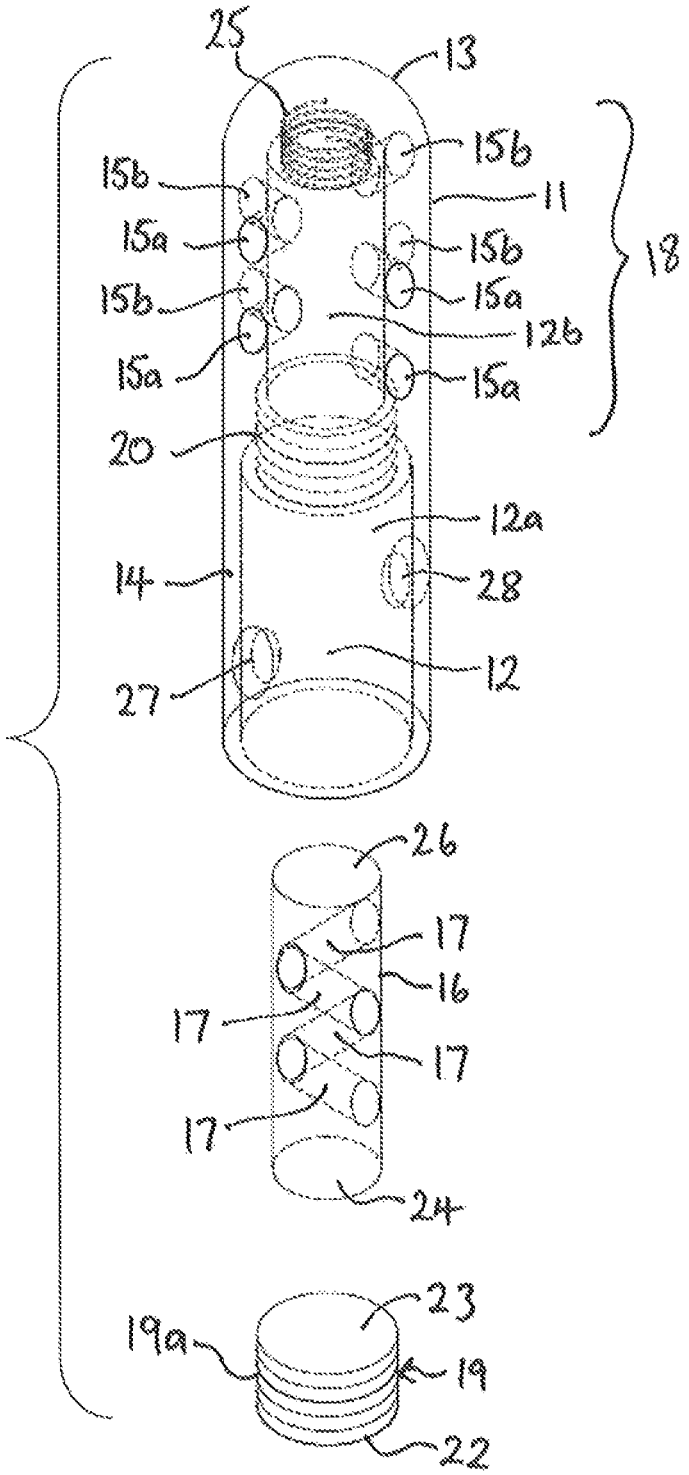
FIG. 2 is an exploded view of the filament retaining device illustrated in FIG. 1, with the apertures and through channels illustrated; and, FIG. 3 is an exploded view of the filament retaining device according to a second embodiment of the present invention, with the apertures and through channels illustrated; and, FIG. 4 is a side view of a chimney and duct cleaning tool according to an embodiment of the present invention.

Referring to FIGS. 1 and 2 of the drawings there is illustrated a filament retaining device 10 according to a first embodiment of the present invention. The device 10 is arranged to retain a plurality of bristles or filaments (see FIG. 3 of the drawings) associated with a chimney and duct cleaning tool 100, such as chimney brush. The retaining device 10 comprises an elongate socket 11 having a central bore 12 disposed therein, which extends along a longitudinal axis of the socket 11. The bore 12 is open at a proximal end of the socket 11 and closed at a distal end by an outwardly domed section 13.

The socket 11 comprises a cylindrical side wall 14 having a plurality of pairs of apertures 15*a*, 15*b* disposed therein. The apertures 15*a*, 15*b* of each pair are located at substantially diametrically opposed positions on the side wall 14, however, in an alternative embodiment it is envisaged that the apertures 15*a*, 15*b* of each pair may be rotationally separated by an angle less than 180° around the socket 11.

The device 10 further comprises an elongate plug 16 which is arranged to move in sliding relation within the bore 12 of the socket 11. The socket bore 12 comprises a first bore section 12*a* disposed at a proximal region of the socket 11 and second bore section 12*b* disposed at a distal region of the socket 11. The second bore section 12*b* comprises a reduced cross-sectional area compared with the first bore section 12*a* and the plug 16 comprises a cross-sectional shape, such as a circular or multifaceted cross-sectional shape, and size, which substantially conforms to the cross-sectional shape and size of the second bore section 12*b*.

The plug 16 further comprises a plurality of channels 17 which extend through the plug 16. The channels 17 are arranged to extend in a separate a plane substantially transverse to a longitudinal axis of the plug 16, and as such, are separated longitudinally of the plug 16. The pairs of apertures 15*a*, 15*b* associated with the socket 11 are longitudinally separated along a filament receiving portion 18 disposed at a distal region of the socket 11 and each channel 17 of the plug 16 is alignable with a respective pair of apertures 15*a*, 15*b*, such that the open ends 17*a* of each channel 17 become aligned with an aperture 15*a*, 15*b* of a respective pair of apertures. In this respect, the longitudinal spacing of the channels 17 along the plug 16 is arranged to substantially correspond with the longitudinal spacing of the pairs of apertures 15*a*, 15*b* along the socket 11. Similarly, the channels 17 may comprise linear channels which extend along a diameter of the plug 16, or arcuate channels which deviate from the diameter, to align with apertures 15*a*, 15*b* of a corresponding pair of apertures.

The retaining device 10 further comprises an adjustment member 19 for adjusting the relative position of the plug 16 along the filament receiving portion 18. The member 19 comprises a detent having an external thread 19*a* disposed thereon, for coupling with an internal thread 20 disposed along the inner side of the side wall 14 of the socket 11, at the junction between the first and second bore section 12*a*, 12*b*. The detent 19 may further comprise a coupling formation (not shown), such as a recess disposed at a proximal end face 22 thereof, for receiving a tool (not shown) for manipulating the detent 19 to screw the detent 19 into and out from the bore 12. A distal end face 23 of the detent 19 is arranged to abut a proximal end 24 of the plug 16 and thus define a minimum separation of the plug 16 from the proximal end of the socket 11.

The device 10 further comprises biasing means 25 for biasing the plug 16 longitudinally of the bore 12, away from the distal end of the socket 11. In the illustrated embodiment, the biasing means comprises a compression spring 25 having a proximal end which is arranged to abut a distal end 26 of the plug 16, and a distal end which is arranged to abut the closed end of the socket 11. The length of the plug 16 and in particular the separation of the channels 17 from the distal end 26 of the plug 16 is arranged such that each channel 17 is arranged to longitudinally align with a respective pair of apertures 15*a*, 15*b*, when the distal end 26 of the plug 16 contacts the proximal end of the spring 25 in the uncompressed state. In order to subsequently align opposite ends of each 17*a* channel 17 with the apertures 15*a*, 15*b* of a respective pair of apertures, the plug 16 simply requires rotating within the bore 12.

The filament retaining device 10 according to the embodiment of the present invention further comprises coupling means disposed in the side wall 14 of the socket 12 at the proximal portion thereof. In the illustrated embodiment, the coupling means comprises a first and second aperture 27, 28 disposed in the side wall 14 thereof. However, in an alternative embodiment, the coupling means may comprise an internal thread (not shown) for example, disposed along an inner side of the side wall 14 of the socket 11, along the proximal portion thereof.

Figure 3:
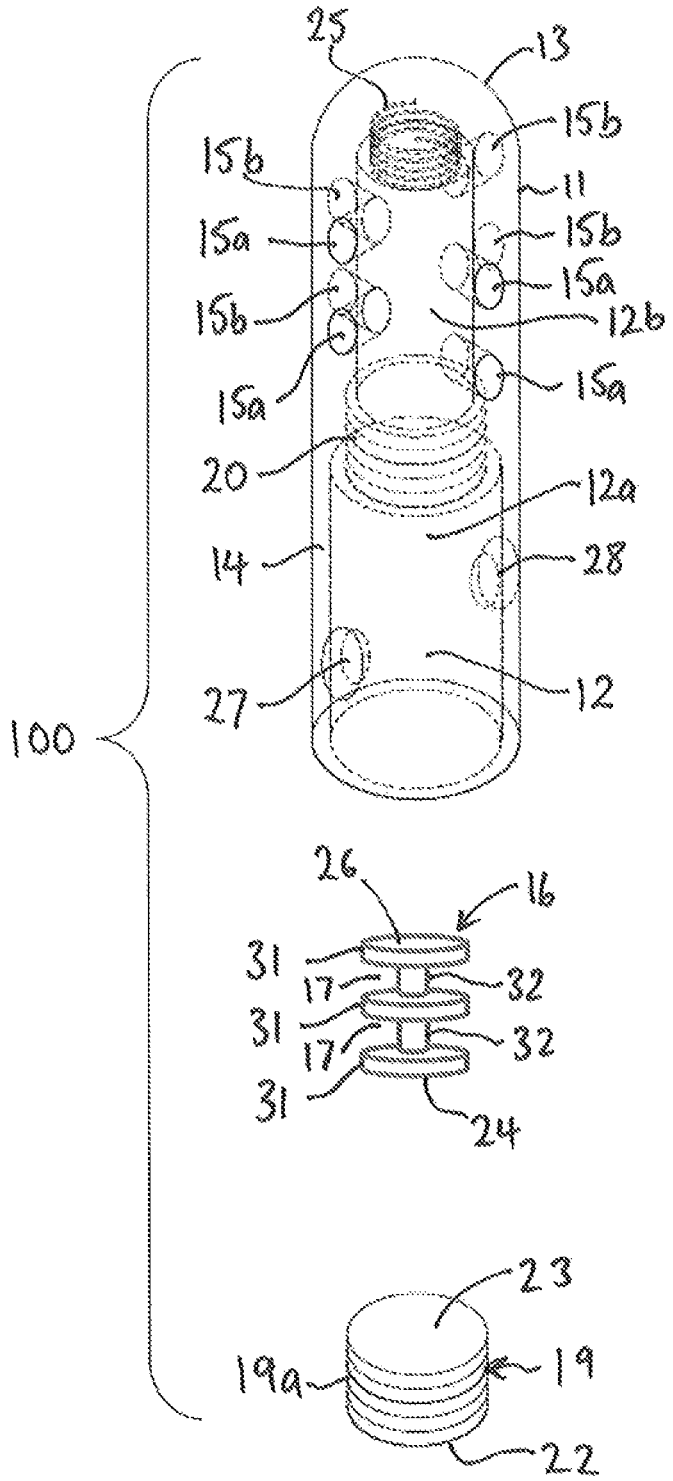

Referring to FIG. 3 of the drawings, there is illustrated a filament retaining device according to a second embodiment of the present invention. The filament retaining device 100 of the second embodiment comprises substantially the same features of the filament retaining device 10 of the first embodiment and so like features have been referenced using the same numerals. The filament retaining device 100 of the second embodiment comprises an alternative plug 16, which comprises a stacked configuration of discs 31 with adjacent discs 31 being separated by a pillar 32. The pillars 32 between adjacent discs 31 of the stack are aligned along a longitudinal axis of the plug 16, which extends through a centre of each disc 31. In this respect, the channels 17 of the plug 16 are defined between adjacent discs 31 of the stack and comprise annular channels 17. It is envisaged that the plug 16 of the filament retaining device 100 of the second embodiment will facilitate a more rapid alignment of the channels 17 with the apertures 15*a*, 15*b* compared with the plug 16 of the first embodiment, since the plug 16 will need to be only suitably positioned along the socket bore 12, without also having to be rotationally aligned within the bore 12.

Figure 4:
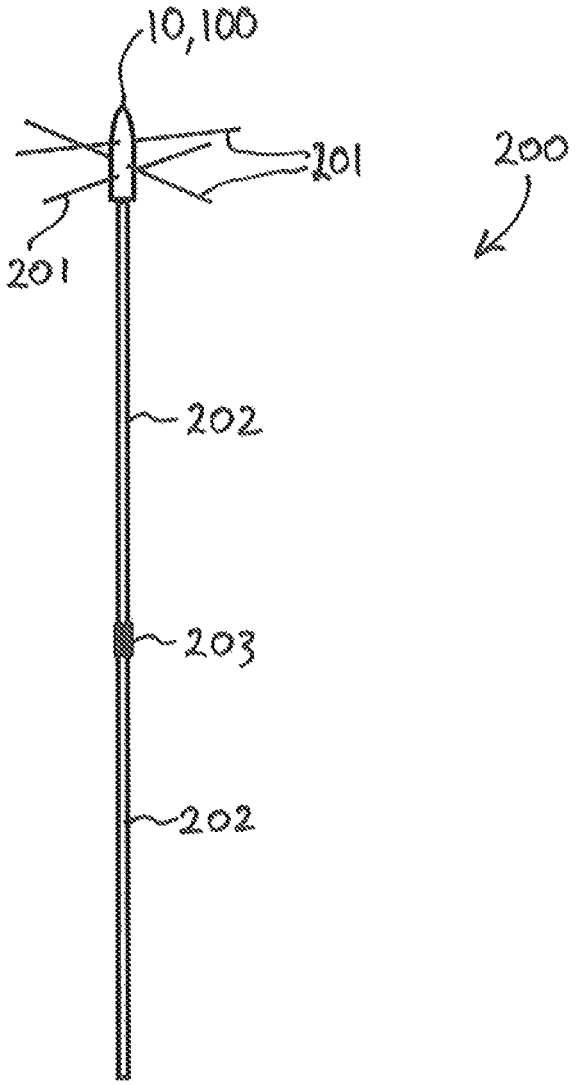

Referring to FIG. 4 of the drawings, there is illustrated a chimney and duct cleaning tool 200 according to an embodiment of the present invention for cleaning the interior of chimneys, flues and ducts (not shown), for example. The tool 200 comprises the filament retaining device 10,100 of the first or second embodiment described above, a plurality of filaments 201 (only three of which are shown for clarity) and a handle 202 for manipulating the tool 100.

In constructing the tool 200 illustrated in FIG. 4, the socket 11 is inverted, so that the closed end thereof is lowermost and the plug 16 is inserted into the bore 12 so that the distal end 26 of the plug 16 abuts the proximal end of the spring 25. The plug 16 is then rotated to suitably align the channels 17 with a respective pair of apertures 15*a*, 15*b* disposed in the side wall 14 of the socket 11. A separate filament 201, such as a nylon strand, section of chain or wire, is then threaded through each pair of apertures 15*a*, 15*b*, along a corresponding channel 17 of the plug 16 and positioned such that approximately the same length of filament 201 extends from each side of the socket 11. Once all the filaments 201 have been suitably threaded, the skilled reader will recognise that the plug 16 will be substantially longitudinally and rotationally locked with respect to the socket 11. However, the filaments 101 may subsequently slide out from the plug 16 and socket 11. Accordingly, the detent 19 is then screwed into the bore 12 until the distal end face 23 of the detent 19 abuts the proximal end of the plug 24. The detent 19 is then further slightly screwed into the bore 12 to effectively urge the plug 16 toward the distal end of the socket 11, against the bias of the spring 25, and thus clamp the filaments 201 at the interface between the plug 16 and socket 11. However, it is to be appreciated that excessive rotation of the detent 19 may shear the filaments 201.

Once the filaments 201 have been suitably positioned and clamped within the socket 11, a handle 202, such as a rod is then coupled with the device. It is envisaged that the rod 202 may comprise an adapter (not shown) disposed at a distal end thereof having a first and second radially moveable protuberance (not shown). The protuberances (not shown) are biased radially outwardly of the rod 202 and are arranged to respectively locate within the first and second apertures 27, 28 disposed at the proximal portion of the socket 11. Further rods 202 may then be coupled together using a similar coupling arrangement 203. With the handle 202 suitably coupled to the filament retaining device 10, the device 10 comprising the filaments 201 may be inserted into a chimney or duct (not shown) and rotated to clean the interior of the chimney or duct.

In order to disassemble the tool 200, the handle 202 may be removed from the retaining device 10 by forcing the protuberances (not shown) radially inwardly of the rod 202 and pulling the rod 202 outwardly of the bore 12. The removal of the handle 202 subsequently exposes the detent 19, which can then be unscrewed to unclamp the filaments 201. The detent does not need to be fully removed from the bore 12, since it is only necessary to release the bias on the spring 25 to unclamp the filaments 201, so that the filaments 201 can be unthreaded from the socket 11 and plug 16.

The invention claimed is:

1. A filament retaining device for a chimney and duct cleaning tool, the device comprising:

a socket having a bore defined by a side wall of the socket and a plurality of pairs of apertures disposed in the side wall of the socket, the pairs of apertures being separated longitudinally of the socket;

a plug arranged to move in sliding relation within the bore of the socket, the plug comprising a plurality of channels disposed therein, the channels being separated longitudinally of the plug and separately alignahle with a pair of apertures in the side wall;

an adjustment member for adjusting a position of the plug within the bore; and a spring placed between the plug and a distal end of the bore for biasing the plug longitudinally of the bore toward the adjustment member, wherein the adjustment member is arranged to adjust the position of the plug inside the bore of the socket to secure a plurality of filaments extending through the plurality of pairs of apertures and the plurality of channels.

2. A filament retaining device according to claim 1, wherein the plurality of pairs of apertures are longitudinally separated along a filament receiving portion of the socket and the adjustment member is arranged to adjust the position of the plug relative to the filament receiving portion.

3. A filament retaining device according to claim 1, wherein the spring is disposed within the bore at a distal region of the socket.

4. A filament retaining device according to claim 1, wherein the adjustment member comprises a detent which is arranged to screw into and out from the bore via a proximal end of the socket.

5. A filament retaining device according to claim 1, wherein the bore comprises a first bore section disposed at a proximal region of the socket and a second bore section disposed at a distal region of the socket.

6. A filament retaining device according to claim 5, wherein the second bore section comprises a reduced cross-sectional area than the first bore section.

7. A filament retaining device according to claim 1, wherein the plug comprises linear channels which extend along a diameter of the plug.

8. A filament retaining device according to claim 1, wherein the channels are angularly separated around the plug.

9. A filament retaining device according to claim 1, wherein the plurality of channels of the plug comprise or further comprise annular channels.

10. A filament retaining device according to claim 9, wherein the plug comprises a plurality of discs arranged in a stacked configuration, and separated by a pillar which extends along an axis of the plug, such that the annular channels are disposed between adjacent discs.

11. A filament retaining device according to claim 1, wherein the apertures of each pair are arranged at diametrically opposed positions of the socket.

12. A filament retaining device according to claim 1, wherein the pairs of apertures are angularly separated with respect to each other, around the socket.

13. A filament retaining device according to claim 1, wherein each channel is arranged to align with a pair of apertures.

14. A filament retaining device according to claim 1, wherein the bore is closed at a distal end of the socket.

15. A filament retaining device according to claim 1, wherein the distal end of the socket is domed.

16. A filament retaining device according to claim 1, further comprising a handle detachably coupled to the device.

17. A chimney and duct cleaning tool, the tool comprising:

a filament retaining device comprising:

a socket having a bore defined by a side wall of the socket and a plurality of pairs of apertures disposed in the side wall of the socket, the pair of apertures being separated longitudinally of the socket;

a plug arranged to move in sliding relation within the bore of the socket, the plug comprising a plurality of channels disposed therein, the channels being separated longitudinally of the plug and separately alignable with a pair of apertures in the side wall;

an adjustment member for adjusting a position of the plug within the bore; and a spring placed between the plug and a distal end of the bore for biasing the plug longitudinally of the bore toward the adjustment member, wherein the adjustment member is arranged to adjust the position of the plug inside the bore of the socket to secure a plurality of filaments extending through the plurality of pairs of apertures and the plurality of channels;

a handle for manipulating the tool.

18. A chimney and duct cleaning tool according to claim 17, wherein the filaments are arranged to separately extend through a pair of apertures within the socket and the channel aligned therebetween.

* * * * *